US008447202B2

(12) United States Patent
Takahashi

(10) Patent No.: US 8,447,202 B2
(45) Date of Patent: May 21, 2013

(54) PRINTING WITHOUT MARGINS-ENABLED IMAGE FORMING APPARATUS AND CONTROL METHOD

(75) Inventor: Masayoshi Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 507 days.

(21) Appl. No.: 11/678,233

(22) Filed: Feb. 23, 2007

(65) Prior Publication Data

US 2007/0201922 A1 Aug. 30, 2007

(30) Foreign Application Priority Data

Feb. 24, 2006 (JP) ..... 2006-048976

(51) Int. Cl.
*G03G 15/00* (2006.01)

(52) U.S. Cl.
USPC ..... 399/82; 399/45; 399/389

(58) Field of Classification Search
USPC ..... 399/45, 81, 82, 197, 389, 66, 101, 399/13, 51, 388, 391, 394, 190, 85
See application file for complete search history.

(56) References Cited

U.S. PATENT DOCUMENTS

| | | | | |
|---|---|---|---|---|
| 5,608,496 | A * | 3/1997 | Hanzawa et al. | 399/81 |
| 6,052,552 | A | 4/2000 | Ohsumi et al. | |
| 6,314,264 | B1 * | 11/2001 | Iida et al. | |
| 6,438,343 | B1 * | 8/2002 | Inoue | |
| 6,895,195 | B2 * | 5/2005 | Katamoto | 399/45 |
| 6,957,885 | B2 * | 10/2005 | Noguchi et al. | 347/101 |
| 2004/0037581 | A1 * | 2/2004 | Maeda | 399/82 |
| 2004/0190927 | A1 * | 9/2004 | Tsukamoto et al. | 399/82 |
| 2004/0212648 | A1 * | 10/2004 | Arakawa et al. | |
| 2005/0213161 | A1 * | 9/2005 | Kawana | 358/3.28 |
| 2006/0216047 | A1 | 9/2006 | Yamamoto et al. | |
| 2007/0025780 | A1 * | 2/2007 | Kurosu et al. | |

FOREIGN PATENT DOCUMENTS

| | | | |
|---|---|---|---|
| JP | 03132673 | A * | 6/1991 |
| JP | 07-209945 | A | 8/1995 |
| JP | 10-186951 | A | 7/1998 |
| JP | 11-268363 | A | 10/1999 |
| JP | 2000-280563 | A | 10/2000 |
| JP | 2003-316224 | A | 11/2003 |
| JP | 2003-323020 | A | 11/2003 |
| JP | 2004-098299 | A | 4/2004 |
| JP | 2004-333935 | A | 11/2004 |
| JP | 2004-341051 | A | 12/2004 |
| JP | 2005-025157 | A | 1/2005 |
| JP | 2005025157 | A * | 1/2005 |
| WO | WO 2004099883 | A1 * | 11/2004 |

* cited by examiner

*Primary Examiner* — Walter L Lindsay, Jr.
*Assistant Examiner* — Milton Gonzalez
(74) *Attorney, Agent, or Firm* — Canon USA Inc. IP Division

(57) ABSTRACT

The present invention provides a printing without margins-enabled image forming apparatus that forms toner image matched to the size and position of the conveyed printing material and suppresses waste toner generation. To accomplish this, the present image forming apparatus includes a printing material detection unit that detects orthogonal direction length, conveying direction length, orthogonal direction position, and conveying direction position associated with the conveyed printing material when a printing without margins is selected by the selection unit. In addition, the present image forming apparatus includes a matching unit which, based on the detected length and conveying position, matches the size of the toner image formed on the printing material to the size of the printing material and matches the formation position of the toner image to the position of the printing material conveyed along the conveying path.

12 Claims, 11 Drawing Sheets

PRINTING WITHOUT MARGINS-ENABLED IMAGE FORMING APPARATUS AND CONTROL METHOD

BACKGROUND OF THE INVENTION

1. Field of the Invention

The present invention relates to an image forming apparatus having a mode to print without margins and a control method therefore.

2. Description of the Related Art

Image forming apparatuses utilizing the electrophotographic process, such as printers, copiers, fax machines, and the like, form toner images, which are initially produced on photosensitive drums serving as first image carriers, on printing paper, transparencies and other printing materials. In addition, to carry out successive transfer of multicolor toner (developer), color image forming apparatuses perform primary transfer onto a rotary belt-shaped second image carrier and then secondary transfer from the second image carrier onto a printing material.

If the toner image is smaller than the size of the printing material, namely, during printing with margins, in which a margin is formed in the edge portion of the printing material, all of the toner in the toner image formed on the second image carrier comes into contact with the printing material during transfer onto the printing material. For this reason, toner of toner image formed on the second image carrier does not adhere to the rotary belt and transfer roller arranged opposite the transfer unit. However, in printing without margins, in which an image is formed over the entire printing material such that no margin is generated in the edge portion of the printing material, the image forming apparatus forms a toner image that is larger than the printing material area such that no margin is formed even if the position of the printing material is slightly shifted relative to the standard position. For this reason, toner used for imaging exceeding the printing material area may adhere to the transfer roller and rotary belt during transfer onto the printing material. Additionally, there is the risk that toner adhered to the transfer roller and rotary belt may be re-transferred to the back surface of the printing material and may cause contamination of back surface. In addition, toner used for imaging exceeding the printing material area does not get transferred onto the printing material and remains as waste toner on the second image carrier. For this reason, it is believed that currently used image forming apparatuses require technology either for removal of such waste toner etc. or for decreasing the amount of waste toner.

JP 2003-316224A (hereinafter, referred to as "Patent document 1") describes a technology which, at a low cost, enables users to accurately ascertain the amount of accumulated waste toner by continuously issuing reminders of changes in the amount of accumulated waste toner.

JP H11-268363A (hereinafter referred to as "Patent document 2") describes a technology, in which material to be printed is adhered to a sheet larger than the material to be printed and an image is formed that is larger than the size of the material to be printed and smaller than the sheet and, after printing, the material is peeled off the sheet. This prevents waste toner from remaining on the second image carrier (intermediate transfer member).

JP 2000-280563A (hereinafter referred to as "Patent document 3") discloses a technology, in which dedicated sheets for printing without margins are used and the peripheral edge portions of the sheets are trimmed after printing. This prevents waste toner from remaining on the second image carrier.

However, in the image forming apparatus of Patent document 1, when the amount of toner in the waste toner container located in the second image carrier reaches a "container full" point, the image forming apparatus has to be stopped, and either a new waste toner container has to be used, or the remaining waste toner has to be discarded. Furthermore, despite the fact that such burdensome operations are required in the image forming apparatus of Patent document 1, there is the risk that the waste toner container may reach a "container full" point. If a "container full" point is reached, the image forming apparatus will stop printing. In addition, in the image forming apparatuses of Patent document 2 and Patent document 3, the user has to trim the sheets or perform other operation after printing, which is extremely burdensome. Furthermore, it is necessary to have dedicated printing material for printing without margins on hand. For this reason, ordinary paper cannot be utilized, printing costs increase, and, in addition, there is the risk that the types of the sheets used may be limited.

SUMMARY OF THE INVENTION

The present invention is capable of providing a printing without margins-enabled image forming apparatus that forms toner images matching the size and position of the conveyed printing material and suppresses the generation of waste toner.

According to an aspect of the present invention, an image forming apparatus includes: an image carrier, on which an electrostatic latent image is formed; an exposure unit forming the electrostatic latent image on the image carrier; a developer developing the electrostatic latent image on the image carrier; a transfer unit including an intermediate transfer member transferring a toner image developed on the image carrier to a printing material; a selection unit selecting whether an image is formed with or without margins on the printing material; a printing material detection unit detecting a printing material length and a printing material position in the conveying direction associated with a conveyed printing material using a sensor arranged in front of the point where the toner image is transferred from the intermediate transfer member to the printing material; a matching unit matching the image size of the toner image formed on the printing material to the size of the printing material based on the printing material length and the printing material position and matching a formation position of the toner image to the printing material position of the printing material conveyed along a conveying path; and an image forming unit forming the toner image on the printing material in accordance with the image size and the formation position matched by the matching unit. When printing without margins is selected, the printing material length and the printing material position associated with the printing material are detected by the printing material detection unit before the image forming unit forms the toner image on the printing material, and the printing material is placed in a standby condition whereupon formation of the electrostatic latent image is started by the exposure unit and the image is formed by the image forming unit.

Further features of the present invention will be apparent from the following description of exemplary embodiments with reference to the attached drawings.

DESCRIPTION OF THE EMBODIMENTS

Exemplary embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

Figure 1:
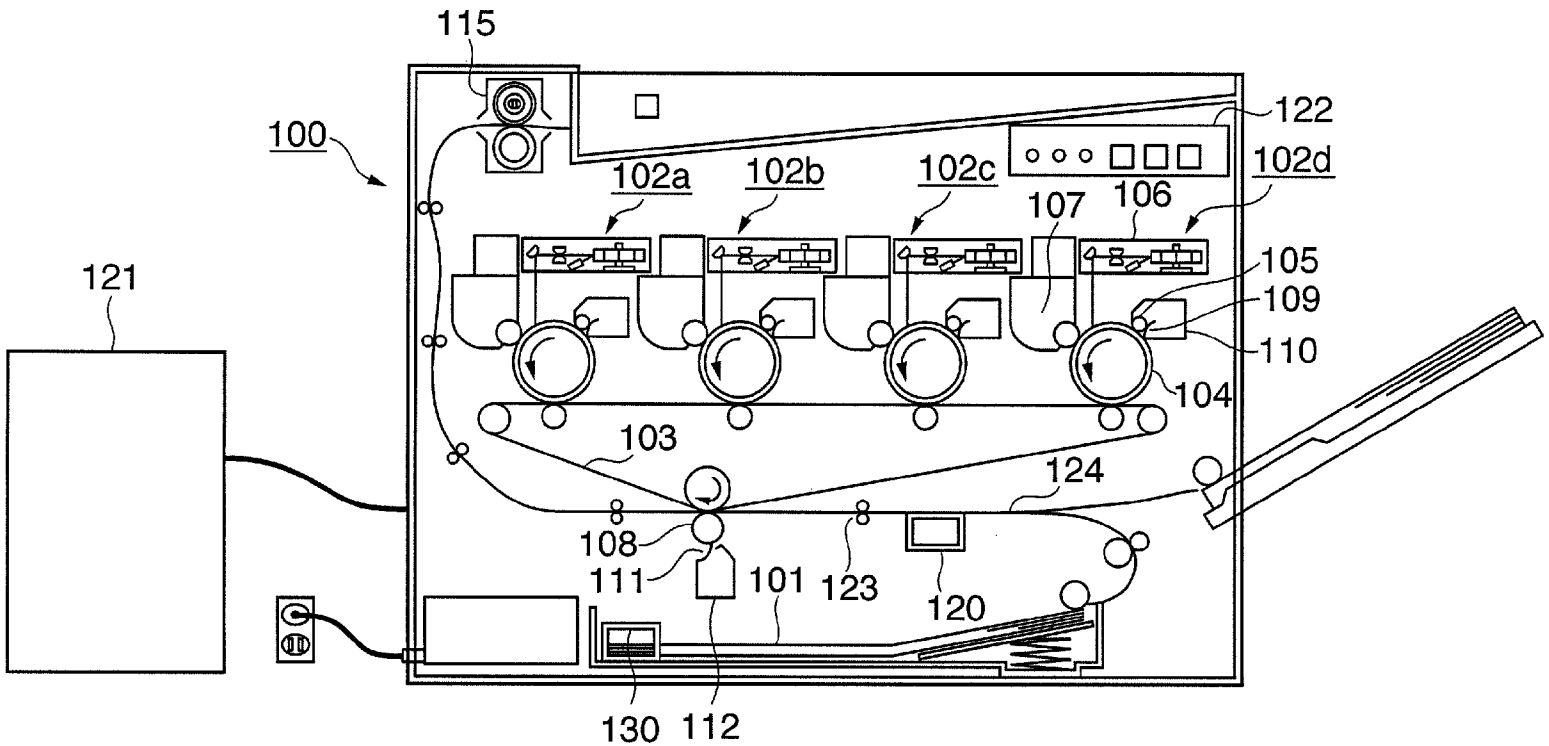
FIG. 1 is a cross-sectional view of an image forming apparatus according to the present invention.

FIG. 1 is a cross-sectional view of an image forming apparatus. An electrophotographic-system color image forming apparatus is an example of the image forming apparatus of the present invention. The image forming apparatus of the present embodiment employs the intermediate transfer system. In addition, only portions relevant to the present invention are explained here.

An image forming apparatus 100 used in the present embodiment includes four image forming units 102 (*a, b, c, d*), an intermediate transfer belt 103, a secondary transfer unit 108, a waste toner container 112, and a fixing unit 115 as the main components involved in image formation. In addition, the image forming apparatus 100 includes a printing material detection unit 120, a paper size sensor 130, a conveying path 124, and registration rollers 123 as the main components involved in conveying printing material 101. Furthermore, the image forming apparatus 100 includes an input device 122 employed by the user for inputting printing-related control instructions. The image forming apparatus 100 is connected to a host computer 121 used for inputting printing instructions to the image forming apparatus 100.

Because the same configuration can be utilized for each of the four image forming units 102 (*a, b, c, d*), descriptions below are provided with reference to a single image forming unit. The image forming unit 102 includes a photosensitive drum 104 serving as an image carrier. In addition, the photosensitive drum 104 is centrally pivoted and rotatably driven in the direction of the arrow shown in FIG. 1. Furthermore, opposite the outer peripheral surface of the photosensitive drum 104, the image forming unit 102 includes, in the direction of rotation, a primary charger 105, an exposure unit 106, a developer unit 107 serving as a developer, and a container 110 for waste toner used for primary transfer.

During image formation, the image forming unit 102 forms a toner image on the photosensitive drum 104. Specifically, the image forming unit 102 uses the primary charger 105 to impart a uniform amount of electrostatic charge to the surface of the photosensitive drum 104. Next, using folding mirrors, the image forming unit 102 exposes the photosensitive drum 104 with a laser beam or other light modulated in accordance with an image signal input to the exposure unit 106. Upon exposure, an electrostatic latent image is formed on the surface of the photosensitive drum 104.

The developer unit 107 holds toner (developer) of four colors, i.e. black, magenta, cyan, and yellow, which are used in each of the image forming units 102 (*a, b, c, d*). The electrostatic latent images on the photosensitive drums 104 are developed by the developer unit 107 into, respectively, black, magenta, cyan, and yellow toner images.

In addition, upon entering into contact with the intermediate transfer belt 103, the photosensitive drum 104 performs primary transfer of the toner image formed on the photosensitive drum 104 onto the intermediate transfer belt 103. Subsequently, toner remaining on the photosensitive drum 104 during primary transfer is scraped off and cleaned away by a primary transfer blade 109. The scraped-off toner is held in the waste toner container 110 as waste toner.

The secondary transfer unit 108 performs a secondary transfer of the toner images formed on the intermediate transfer belt 103 onto the printing material 101. In order to perform the secondary transfer of the toner image onto the printing material 101, the secondary transfer unit 108 is provided with two rollers arranged in a facing configuration, with the intermediate transfer belt 103 running in between. The rollers are held in contact with the intermediate transfer belt 103 under appropriate pressure to perform secondary transfer of the toner image onto the conveyed printing material 101. Toner remaining on the rollers during secondary transfer is scraped off by a secondary transfer blade 111 and held in a waste toner container 112 as waste toner. After that, the fixing unit 115 permanently fixes the image formed on the printing material 101.

The printing material 101 is supplied from a holding cassette or a manual-feed tray and conveyed along the conveying path 124 to the registration rollers 123. The paper size sensor 130 outputs the paper size of the supplied printing material 101, e.g. A4, B5, and other size designations. After that, the registration rollers 123 forward the printing material 101 to the secondary transfer unit 108 in accordance with the image formation timing.

If printing without margins is selected, the image forming apparatus 100 detects a printing material length (a size) including an orthogonal direction length in orthogonal direction to a conveying direction of the printing material and a conveying direction length in the conveying direction, and a printing material position (a conveying position) including an orthogonal direction position in the orthogonal direction and a conveying direction position in the conveying direction of the conveyed printing material 101 using the printing material detection unit 120. Here, the term "orthogonal direction position" refers to a position along the conveying path of the conveyed printing material 101. Namely, a printing material position is the distance from the end of a predetermined conveying path to a prescribed position of the conveyed printing material 101. The prescribed position of the printing material 101 is, for example, the shortest end of the printing material 101 in a direction orthogonal to the conveying direction from the end of the conveying path mentioned above. Note that the orthogonal direction means a main scanning direction where laser scans surface of the photosensitive drum 104. As far as the conveying direction position is concerned, it may be sufficient for the printing material detection unit 120 to simply detect the time elapsed between the arrival of the front edge of the printing material 101 and the moment when the rear edge is detected. The lengths and positions detected by the printing material detection unit 120 are used to match the toner images formed on the photosensitive drums 104 to the size and conveying position of the conveyed printing material 101. The conveying direction position is used for aligning the front edge positions of the printing material 101 and the toner image formed on the intermediate transfer belt 103.

In addition, if printing with margins is selected, the image forming apparatus 100 detects the conveying position of the conveyed printing material 101 in the conveying direction relative to the conveying path 124 using the printing material detection unit 120. The detected conveying position is used to perform a registration process in the secondary transfer unit 108 to match the positions of the printing material 101 and the toner image formed on the intermediate transfer belt 103.

The printing without margins operation of the image forming apparatus is explained below. The image forming apparatus 100 starts the printing operation after input from the input device 122 or from the host computer 121. At first, the image forming apparatus 100 feeds and conveys the selected printing material 101. The printing material 101 being fed is conveyed towards the printing material detection unit 120. Further, the printing material 101 conveyed to the printing material detection unit 120 is conveyed across the printing material detection unit 120. When the printing material 101 arrives, the printing material detection unit 120 detects the length and conveying position of the printing material 101 described above.

Upon detection of the length and conveying position of the printing material, the image forming apparatus 100, based on the above information, outputs an image signal used for forming a toner image to the image forming unit 102. Next, in response to the output image signal, the exposure unit 106 exposes the photosensitive drum 104 and forms an electrostatic latent image. Upon formation of an electrostatic latent image on the photosensitive drum 104, the electrostatic latent image is developed by the developer unit 107. The developed toner image is subjected to primary transfer onto the intermediate transfer belt 103 from an image forming unit 102*a*, which is located upstream relative to the direction of rotation of the intermediate transfer belt 103. Subsequently, as the intermediate transfer belt 103 rotates successive toner images are formed in a multilayer configuration by the image forming units 102*b*, 102*c*, and 102*d*.

During the period between the end of detection of the printing material 101 by the printing material detection unit 120 and the primary transfer of the toner image onto the intermediate transfer belt 103, the printing material 101 is in standby condition at the registration rollers 123. After that, the image forming apparatus 100 uses the registration rollers 123 to regulate the conveying speed of the printing material 101 such that the toner image that has completed primary transfer and the front edge of the printing material 101 are aligned in the secondary transfer unit 108. Upon completion of secondary transfer of the toner image on the intermediate transfer belt 103 onto the printing material 101, the printing material 101, onto which the toner image has been secondarily transferred, undergoes toner image fixing in the fixing unit 115 and is discharged from the image forming apparatus 100.

Next, descriptions are provided regarding the printing with margins operation of the image forming apparatus. The image forming apparatus 100 starts the printing operation after input from the input device 122 or from the host computer 121. At first, the image forming apparatus 100 feeds and conveys the selected printing material 101. The paper size sensor 130 outputs the size designation of the printing material 101 being fed to the control unit. Based on the size designation, the image forming apparatus 100 sends an image signal used for toner image formation to the image forming unit 102. In response to the input image signal, the exposure unit 106 exposes the photosensitive drum 104 to form an electrostatic latent image. Subsequently, in the same manner as in the printing without margins mode, the image forming unit 102 develops the electrostatic latent image and performs primary transfer of the toner image to the intermediate transfer belt.

On the other hand, the printing material 101 being fed is conveyed to the printing material detection unit 120 and the conveying position of the conveyed printing material 101 is detected. After that, based on the detected conveying position, the image forming apparatus 100 carries out a registration process and performs secondary transfer of the toner image onto the printing material 101. Furthermore, the printing material 101, onto which the toner image has been secondarily transferred, undergoes toner image fixing in the fixing unit 115 and is discharged from the image forming apparatus 100.

Figure 2:
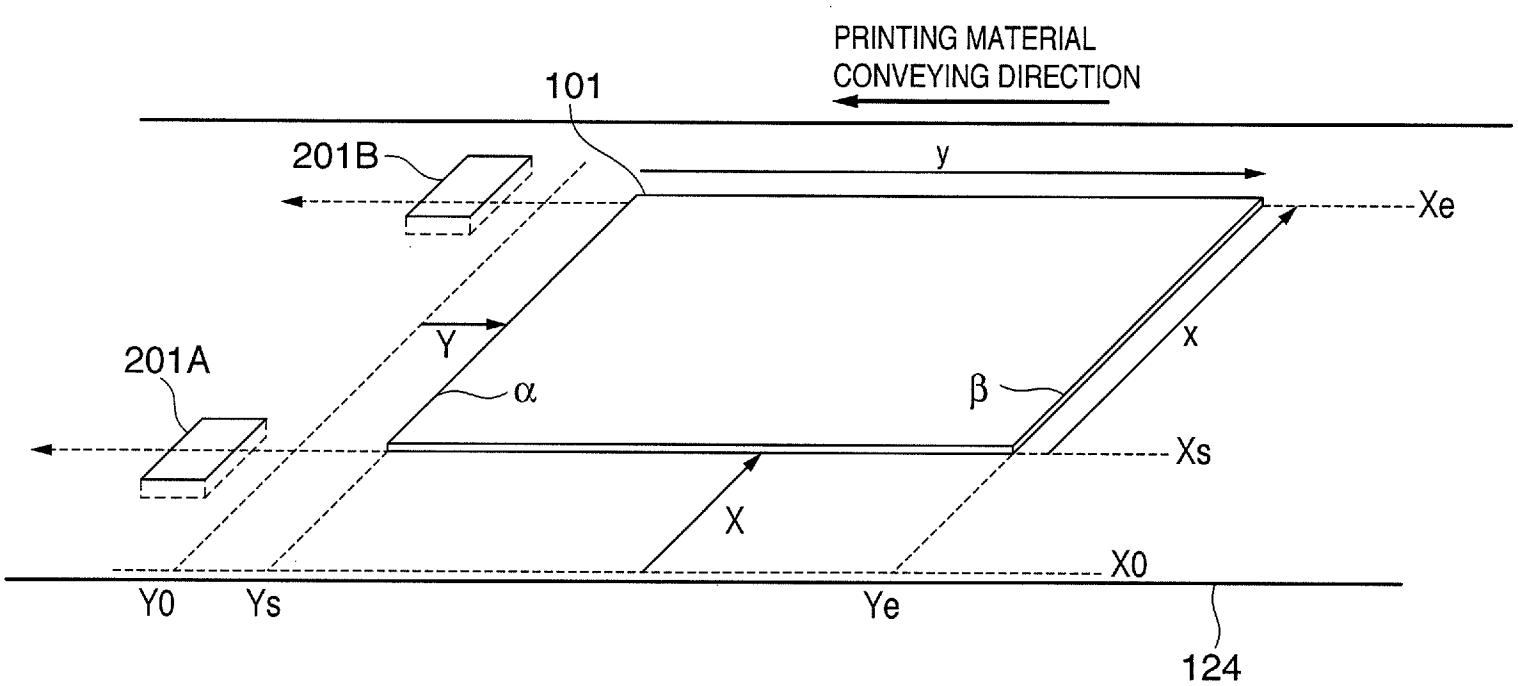
FIG. 2 is a diagram illustrating the method of printing material detection in a printing material detection unit.

FIG. 2 is a diagram illustrating the method of printing material detection in the printing material detection unit 120. In the following, information detected by the printing material detection unit 120 is detected primarily when printing without margins is selected.

The printing material detection unit 120 includes printing material detecting sensors 201A and 201B. According to the present embodiment the size and position of the printing material have to be detected with greater accuracy than heretofore. The printing material detecting sensors 201A, 201B can utilize imaging elements such as, e.g. CCD sensors or C-MOs sensors. In addition, as shown in FIG. 2, the printing material detecting sensors 201A, 201B are built in along the orthogonal direction lines of the conveying path 124.

The printing material detecting sensors 201A, 201B detect the positions, where the printing material 101 passes over the printing material detecting sensors 201A, 201B. The output signals of the printing material detecting sensors 201A, 201B show the orthogonal direction length x, conveying direction length y, orthogonal direction position X, and conveying direction position Y of the conveyed printing material 101. The relationship between the output signals and the length and conveying position of the printing material 101 will be explained below with reference to FIG. 3.

The lengths x, y and conveying positions X, Y detected by the printing material detection unit 120 represent the following contents. The orthogonal direction length x represents the distance from Xs to Xe of the printing material 101. The conveying direction length y represents the distance from Ys to Ye of the printing material 101. The orthogonal direction position X represents the distance from a reference line X0 at an end of a given conveying path 124 to the lengthwise edge of the printing material 101 shown in FIG. 2 which is adjacent to the reference line X0. The conveying direction position Y represents the distance from a predetermined reference line Y0 to the location of the front edge of the printing material 101 in the conveying direction along the predetermined conveying path 124.

The conveying direction position Y is also detected if printing with margins is selected. Information on the conveying direction position Y is used during secondary transfer in the secondary transfer unit 108 in order to carry out the registration process, which aligns the positions of the printing material 101 and the toner image formed on the intermediate transfer belt 103.

The image forming apparatus 100 measures the size and conveying position of the conveyed printing material in greater detail than heretofore. This is done in order to form toner images substantially equal in size to the printing material if printing without margins is selected. The size of the printing material can be identified by the type of the printing material (e.g., A4, A3, etc.). However, for example, for printing materials of the A4-size, the actual size slightly varies (for example, by 0.5 mm or so) depending on the manufacturer. For this reason, to beneficially reduce the amount of waste toner, the image forming apparatus 100 has to accurately measure the size of the conveyed printing material. In addition, when a toner image is transferred to the printing material, a shift of, e.g. 0.5 mm, results in generation of residual toner on the intermediate transfer member. Consequently, the present image forming apparatus 100 has to accurately match the formation position of toner image to the conveying position of the conveyed printing material. For this reason, it is desirable for the present image forming apparatus 100 to measure the conveying position of the conveyed printing material. As a side effect, the present image forming apparatus 100 is capable of printing without margins on rectangular printing materials of arbitrary sizes.

Figure 3:
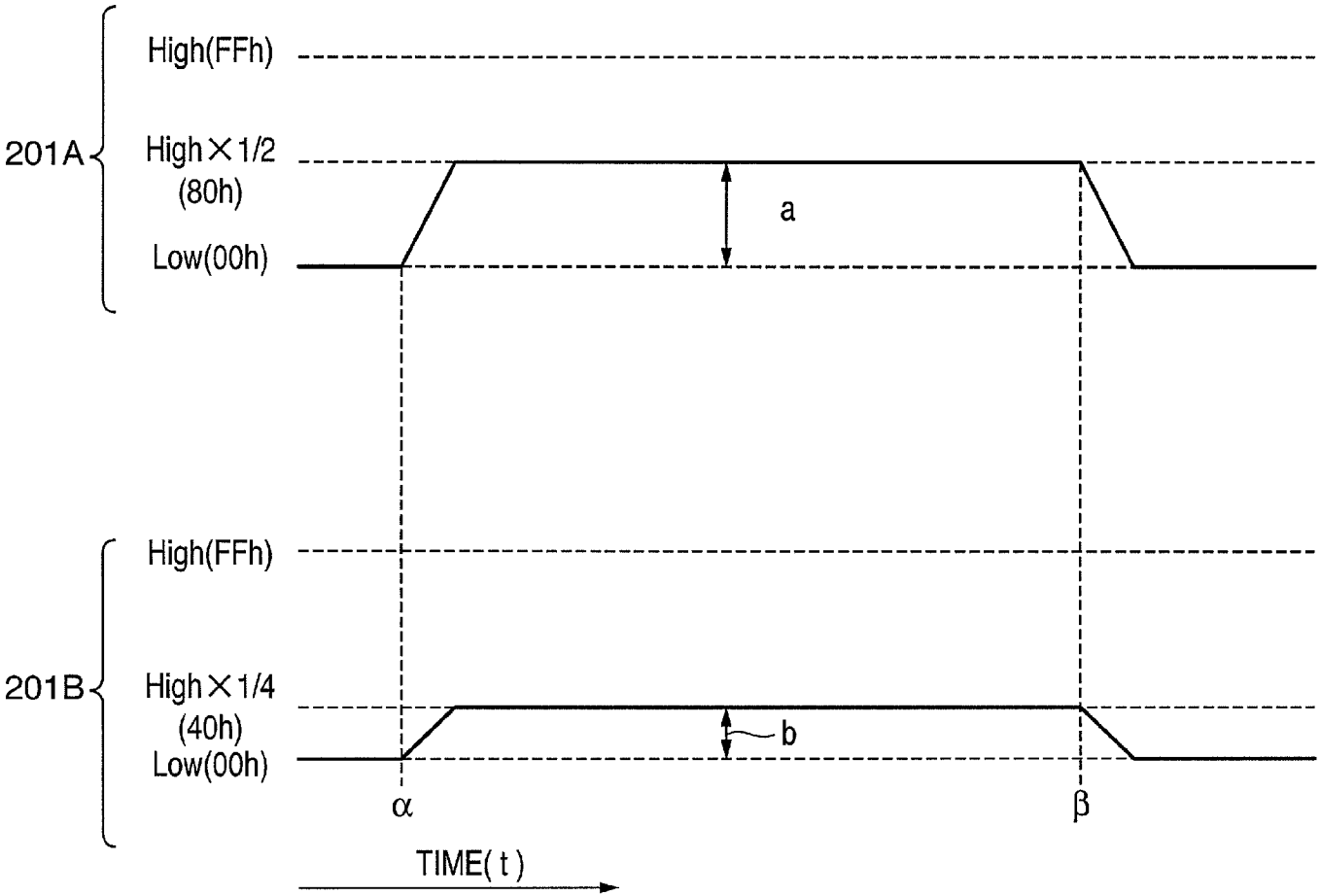
FIG. 3 is a diagram showing output signals when the printing material detection unit detects printing material.

FIG. 3 is a diagram showing output signals obtained when the printing material detection unit 120 detects printing material. Here, descriptions will be provided regarding the relationship between the output signals of the printing material detection unit 120 and the length and conveying position of the printing material 101. The chart shown in FIG. 3 has time (t) plotted in the direction of the X-axis, with the output signals of the printing material detecting sensors 201A, 201B having values ranging from Low (00h) to High (FFh).

When the printing material 101 is conveyed across the printing material detecting sensors 201A, 201B, the printing material detecting sensors 201A, 201B output signals other than 00h. In addition, as shown in FIG. 3, the output signal is, for instance, an 8-bit analog signal. When the printing material 101 completely covers the printing material detecting sensors 201, the printing material detecting sensors 201 output a High (FFh), and when half of their surface area is covered, they output 80h, i.e. half of the value of a High. In addition, when the printing material 101 does not cover the printing material detecting sensors 201 at all, the printing material detecting sensors 201 output a Low (00h).

The time α shown in FIG. 3 represents the timing when the front edge of the printing material 101, moving in the conveying direction, reaches the printing material detecting sensors 201A, 201B. In addition, time β shown in FIG. 3 represents the timing when the rear edge of the printing material 101, moving in the conveying direction, reaches the printing material detecting sensors 201A, 201B. The symbols a, b shown in FIG. 3 are values representing a state, in which the output signals of the printing material detecting sensors 201A, 201B have stabilized. They show output signals obtained in a state, in which the front edge of the printing material 101 has passed over the printing material detecting sensors 201A, 201B but the rear edge has yet to arrive. In other words, the length covered by the printing material 101 in the orthogonal direction of the respective printing material detecting sensors 201 is obtained from these values a, b.

The orthogonal direction position X is obtained from the above-mentioned covered length and the location of the printing material detecting sensors 201 relative to the conveying path 124. In addition, the orthogonal direction length x is obtained from the above-mentioned covered length and the distance between the printing material detecting sensor 201A and the printing material detecting sensor 201B. The conveying direction length y is obtained from the interval between α and β and the conveying speed of the printing material 101. The conveying direction position Y is obtained based on the time when the printing material 101 reaches the printing material detecting sensors 201 from a predetermined position along the conveying path 124. However, because the conveying direction position Y is used to carry out the registration process, which aligns the positions of the front edge of the printing material 101 and the front edge of the toner image, it is sufficient to know the time when the front edge of the printing material 101 is detected. Therefore, it is sufficient to know the time α shown in FIG. 3.

Embodiment 1

Figure 4:
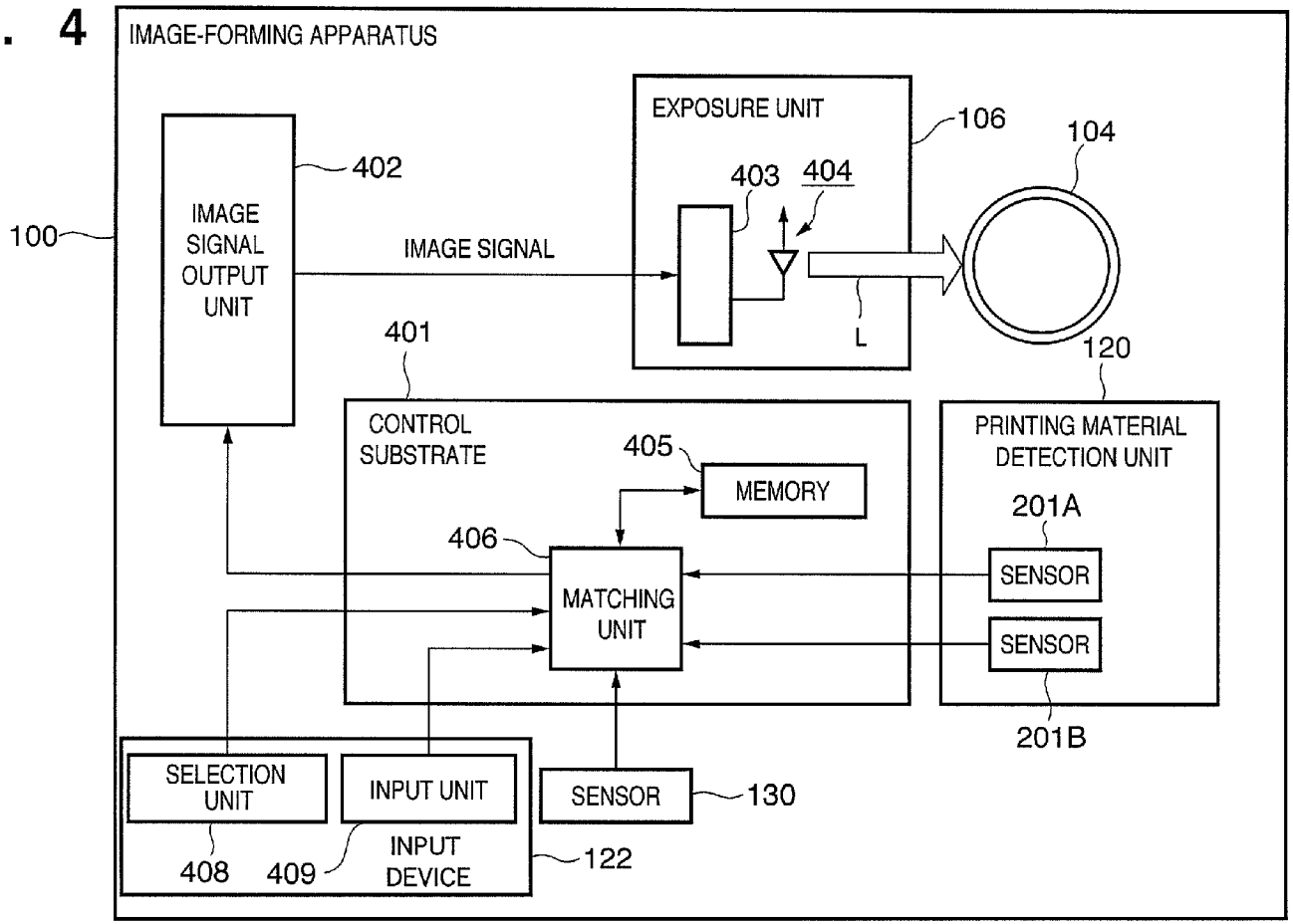
FIG. 4 is a block diagram illustrating control of an image forming apparatus in a first embodiment.

FIG. 4 is a block diagram illustrating control of the image forming apparatus 100 in a first embodiment. Only elements relevant to the present invention are explained here. In other words, the image forming apparatus of the present invention is not limited to the elements shown in FIG. 4. The image forming apparatus 100 of the present embodiment adjusts the output timing of the image signals used to form toner images input to the exposure unit 106. As a result, the present image forming apparatus 100 matches the formation position of the toner image to the conveying position of the printing material 101 and, along with that, matches the size of the toner images to the size of the printing material 101.

The image forming apparatus 100 includes a control substrate 401 and an image signal output unit 402. The control substrate 401 exercises control over the image forming apparatus 100 and includes a matching unit 406 and a memory 405. It should be noted that only elements relevant to the present invention are described here and descriptions and drawings concerning other elements are omitted. The image signal output unit 402 outputs image signals used to form toner images to the exposure unit 106. These image signals are made up of a plurality of pulses having a pulse width corresponding to the length of the toner image in the orthogonal direction.

The input device 122 includes a selection unit 408, which is used to select whether a printing without margins image is formed or a printing with margins image is formed, and an input unit 409 used for inputting adjustment values for the formation position in the orthogonal direction and adjustment values for the formation position in the conveying direction. The selection unit 408 and input unit 409 may form part of the host computer 121. The exposure unit 106 includes a laser driver integrated circuit (IC) 403, which accepts image signals from the image signal output unit 402 as input, and a laser diode 404, which exposes the photosensitive drum 104.

If printing without margins is selected by the selection unit 408, information details on the size and conveying position of the conveyed printing material 101 are input from printing material detection unit 120 to the matching unit 406. Next, based on the input size and conveying position of the printing material 101, the matching unit 406 adjusts the output timing of the image signal output from the image signal output unit 402 to the exposure unit 106. A detailed description of the output timing of the image signal is provided below with reference to FIG. 5. The adjusted output timing is input to the image signal output unit 402. After the output timing has been input, the image signal output unit 402 outputs the image signal to the exposure unit 106 in accordance with the inputted output timing. In other words, the output timing of the image signal is determined by the output signals of the printing material detecting sensors 201A, 201B. When the image signal is input to the laser driver IC 403 in the exposure unit 106, the exposure unit 106 causes the laser diode 404 to carry out exposure in response to the input signal. As a result, the photosensitive drum 104 is irradiated by a laser beam light L and an electrostatic latent image is formed.

As a result, the electrostatic latent image is formed to match the size and conveying position of the printing material 101. The toner image is developed by the developer unit 107 based on the formed electrostatic latent image. For this reason, the present image forming apparatus 100 is capable of suppressing the generation of residual toner during secondary transfer onto the printing material 101. The memory 405 is a nonvolatile memory, which may store the orthogonal direction length x and the conveying direction length y. In such a case, the matching unit 406 can use this stored information to determine the output timing of the image signal. However, due to the fact that printing materials belonging to the same size class slightly differ in size depending on the manufacturer, printing material sizes can be stored based on manufacturer. In this case, detection of the conveying position of the printing material is also necessary.

If printing with margins is selected using the selection unit 408, the size designation of the printing material 101 being fed is input from the paper size sensor to the matching unit 406. First of all, the matching unit 406 outputs the size designation to the image signal output unit 402. Next, the image signal output unit 402 outputs an image signal to the exposure unit 106 in accordance with the size designation. After the image signal has been input to the laser driver IC 403 in the exposure unit 106, the laser diode 404 carries out exposure in response to the inputted signal. As a result, the photosensitive drum 104 is irradiated by the laser beam light L and an electrostatic latent image is formed.

Figure 5:
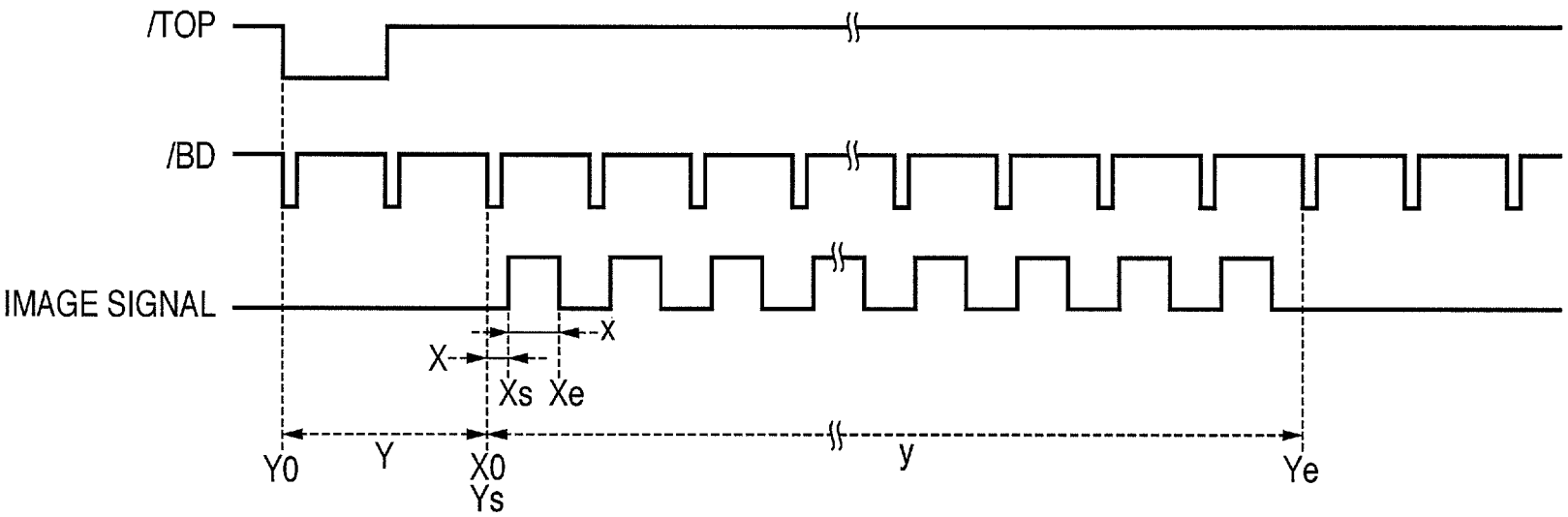
FIG. 5 is a timing chart of an image signal obtained in a case where printing without margins is selected in the first embodiment.

FIG. 5 is a timing chart of an image signal obtained when printing without margins is selected in the first embodiment. /TOP shows a reference signal used for the conveying direction and /BD shows a reference signal used for the orthogonal direction. The image signal is output from the image signal output unit 402 to the exposure unit 106 and is made up of a plurality of pulses having a pulse width corresponding to the length of the toner image in the orthogonal direction.

Upon elapse of the timing corresponding to the distance of the conveying direction position Y detected by the printing material detection unit 120 in conjunction with the reference signals /TOP and /BD, the image signal output unit 402 starts outputting the image signal. Furthermore, upon elapse of the timing corresponding to the orthogonal direction position X, the image signal output unit 402 outputs an initial pulse having a pulse width corresponding to the orthogonal direction length x.

After that, upon elapse of a timing corresponding to the orthogonal direction position X, for each orthogonal direction reference signal /BD, the image signal output unit 402 outputs a plurality of pulses having a pulse width corresponding to the orthogonal direction length x. This plurality of pulses is output continuously, starting from the moment when the initial pulse is output and until the output of a pulse corresponding to the length y of the printing material 101 in the conveying direction.

In this manner, the present image forming apparatus 100 adjusts the output timing of the image signal output from the image signal output unit 402 based on the size and conveying position of the printing material 101 detected by the printing material detection unit 120. As a result, the formed toner image is matched to the size and conveying position of the printing material 101.

Figure 6:
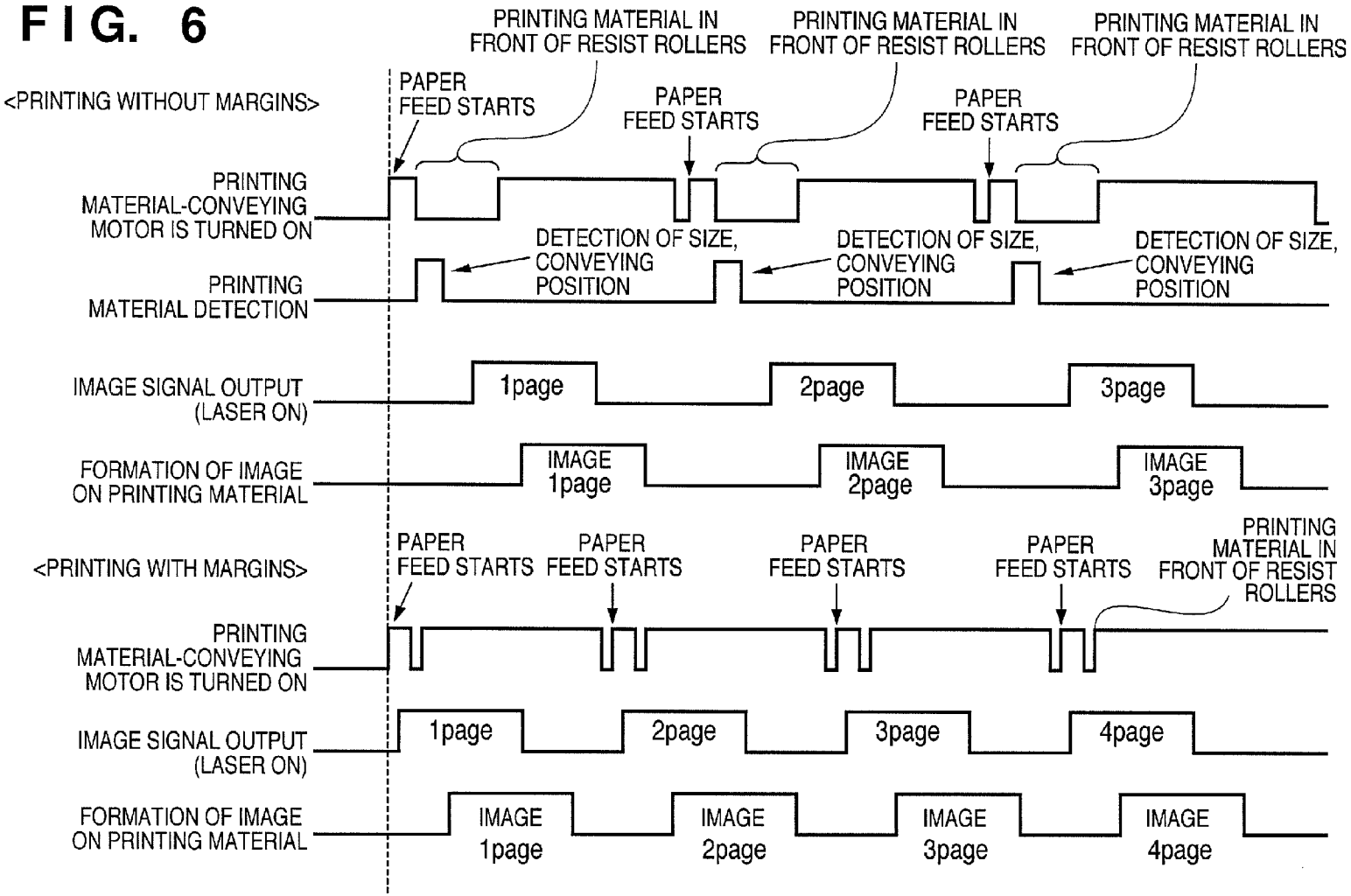
FIG. 6 is a timing chart showing the timing of image formation during printing without margins and printing with margins.

FIG. 6 is a timing chart showing the timing of image formation during printing without margins and printing with margins. Here, descriptions will be provided regarding the drive timing of the conveying motor used for conveying the printing material 101, the timing of detection of the size and conveying position of the printing material 101 by the printing material detecting sensors 201, the output timing of the image signal, and the timing of image formation on the printing material 101. The conveying of the printing material 101 is performed by rotating the feed rollers, registration rollers 123, and other rollers by controlling the conveying motor.

In case of printing without margins, when paper feed starts, the printing material detection unit 120 detects the orthogonal direction length x, conveying direction length y, orthogonal direction position X, and conveying direction position Y of the printing material 101 using the printing material detecting sensors 201. In a case of printing without margins, image signals are output based on the results of detection of the printing material 101 by the printing material detection unit 120 and, consequently, no image signal output is carried out until the end of detection of the printing material 101. The printing material 101 is subjected to a registration process to adjust the timing of conveying through the location of the registration rollers 123. The registration process is carried out in order to align the front edge of the toner image formed on the intermediate transfer belt 103 and the front edge of the printing material 101 in the secondary transfer unit 108 by stopping or decelerating the printing material 101 at the location of the registration rollers 123.

On the other hand, in case of printing with margins, the printing material detection unit 120 does not have to detect the orthogonal direction length x, conveying direction length y, or orthogonal direction position X of the printing material 101. In case of printing with margins there is margin around the edge of the printing material 101 and even if the position of formation is slightly shifted, no waste toner is generated, which is why there is no need to detect the printing material 101 with accuracy. Consequently, when paper feed starts, the image signal output unit 402 outputs an image signal according to the size designation of the printing material 101 being fed. For this reason, during printing with margins, the time required for adjustment at the location of the registration rollers 123 is shortened in comparison with printing without margins because the image signal is output and the toner image is formed nearly simultaneously with the feeding of the printing material 101. Thus, printing with margins provides for an efficient printing process.

Figure 7:
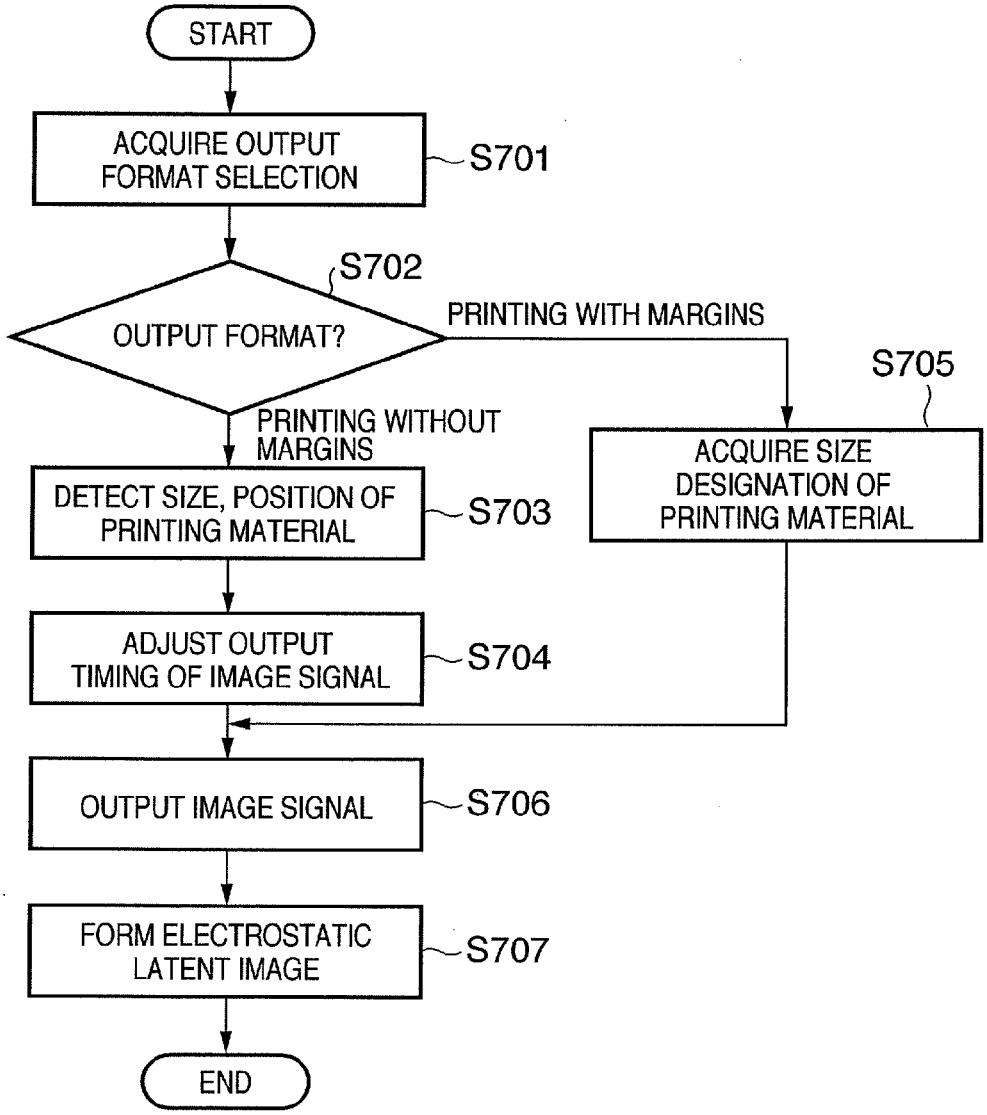
FIG. 7 is a flowchart illustrating control up to the moment of electrostatic latent image formation in the first embodiment.

FIG. 7 is a flowchart illustrating control up to the moment of electrostatic latent image formation in the first embodiment. According to the first embodiment, the matching unit 406 adjusts the output timing of the image signal and matches the formed toner image to the size and conveying position of the printing material 101 based on the size or conveying position of the printing material 101 detected by the printing material detection unit 120.

In Step S701, the selection unit 408 transmits the printing without margins or printing with margins mode input by the user to the matching unit 406. Upon selection of the printing mode, in Step S702, the matching unit 406 determines whether the printing mode is printing without margins or printing with margins. If printing without margins has been selected, in Step S703, the matching unit 406 acquires the size and conveying position of the printing material 101 detected by the printing material detection unit 120.

Subsequently, in Step S704, a signal that adjusts the output start timing or output completion timing of the image signal output from the image signal output unit 402 is output by the matching unit 406 to the image signal output unit 402. As was described with reference to FIG. 5, the output start timing is determined from the orthogonal direction position X and conveying direction position Y. In addition, as far as the output completion timing is concerned, the output completion timing for each pulse is determined from the orthogonal direction length x, and the output completion timing for the image signal as a whole is determined from the conveying direction length y.

After adjusting the output timing of the image signal, in Step S706, the image signal output unit 402 outputs the image signal to the exposure unit 106 in accordance with the timing input from the matching unit 406. Finally, in Step S707, the exposure unit 106 forms an electrostatic latent image by scanning exposure of the photosensitive drum 104 in response to the image signal output from the image signal output unit 402.

On the other hand, if it is determined in Step S702 that printing with margins is selected, in Step S705, the matching unit 406 acquires the size designation of the printing material 101 from the paper size sensor 130. The matching unit 406 transmits the acquired size designation to the image signal output unit 402. Subsequently, processing similar to printing without margins is executed in Steps S706 and S707.

As described above, the image forming apparatus according to the present embodiment includes a selection unit used for selecting whether the formation of images on the printing material is performed with margins or without margins. In addition, the present image forming apparatus includes a printing material detection unit used for detecting the orthogonal direction length, conveying direction length, orthogonal direction position, and conveying direction position associated with the conveyed printing material when a printing without margins is selected via the selection unit. In addition, the present image forming apparatus includes a matching unit which, based on the detected length and conveying position, matches the image size of the toner image formed on the printing material to the size of the printing material and, along with that, matches the formation position of the toner image to the conveying position of the printing material conveyed along the conveying path. Furthermore, the present image forming apparatus includes image forming units forming toner images on the printing material in accordance with the image forming position and image size matched by the matching unit. As a result, because the present image forming apparatus matches the formed toner image to the size and conveying position of the printing material when printing without margins is selected, it can reduce the amount of toner remaining on the intermediate transfer belt during the formation of images on the printing material. As a result, in case of printing without margins, the present image forming apparatus does not form toner images that are larger than the printing material and, therefore, can reduce the amount of spent toner and suppress the generation of waste toner.

It should be noted that the present invention is not limited to the embodiment described above and permits various modifications. For example, the image forming units may include image carriers, and image signal output units outputting image signals used to form toner images, with the image signals made up of a plurality of pulses having a pulse width corresponding to the length of the toner images in the orthogonal direction. In addition, the image forming units may include exposure units forming electrostatic latent images by performing scanning exposure of the image carriers in accordance with the image signal and image sizes and positions of formation matched by the matching unit. Furthermore, the image forming units may include developer material carriers forming toner images by developing electrostatic latent images formed on the image carriers with the help of a developer. As a result, the present image forming apparatus does not need to spend excessive amounts of toner because at the moment when electrostatic latent images are formed, they are matched to the size and conveying position of the printing material. Thus, the present image forming apparatus can reduce the amount of spent toner and suppress the generation of waste toner.

In addition, the matching unit adjusts the output start timing of each pulse of the image signal based on the detected conveying position of the printing material and also adjusts the output completion timing of each pulse of the image signal based on the detected length of the printing material. In this case, image signal output unit outputs the image signal to the exposure unit in accordance with the adjusted output start timing and output completion timing. As a result, the present image forming apparatus does not need to spend excessive amounts of toner because, as a result of the image signal adjustment, electrostatic latent images are matched to the size and conveying position of the printing material at the moment of formation. Thus, the present image forming apparatus can reduce the amount of spent toner and suppress the generation of waste toner.

In addition, if a printing with margins is selected, the printing material detection unit may bypass at least the detection of the orthogonal direction length, the conveying direction length, and the orthogonal direction position of the printing material. Consequently, if printing without margins is selected, the present image forming apparatus accurately detects the size and conveying position of the printing material and thus reduces the amount of spent toner and suppresses the generation of waste toner. At the same time, if printing with margins is selected, the present image forming apparatus simplifies the detection of the printing material by the printing material detection unit and is thus capable of carrying out efficient printing.

Furthermore, if printing with margins is selected, the image forming units may start forming electrostatic latent images before the conveying position of the printing material in the conveying direction is detected. Furthermore, the image forming units may carry out a registration process to align the conveying position of the toner image in the conveying direction with the conveying position of the printing material in the conveying direction after the conveying direction position has been detected. As a result, if printing with margins is selected, the present image forming apparatus starts forming electrostatic latent images simultaneously with the start of paper feed, and therefore, the period for which the conveying of the printing material is stopped for adjustments made in the registration process and the development period may be shortened. Thus, if printing with margins is selected, the present image forming apparatus can perform efficient printing.

Embodiment 2

Figure 8:
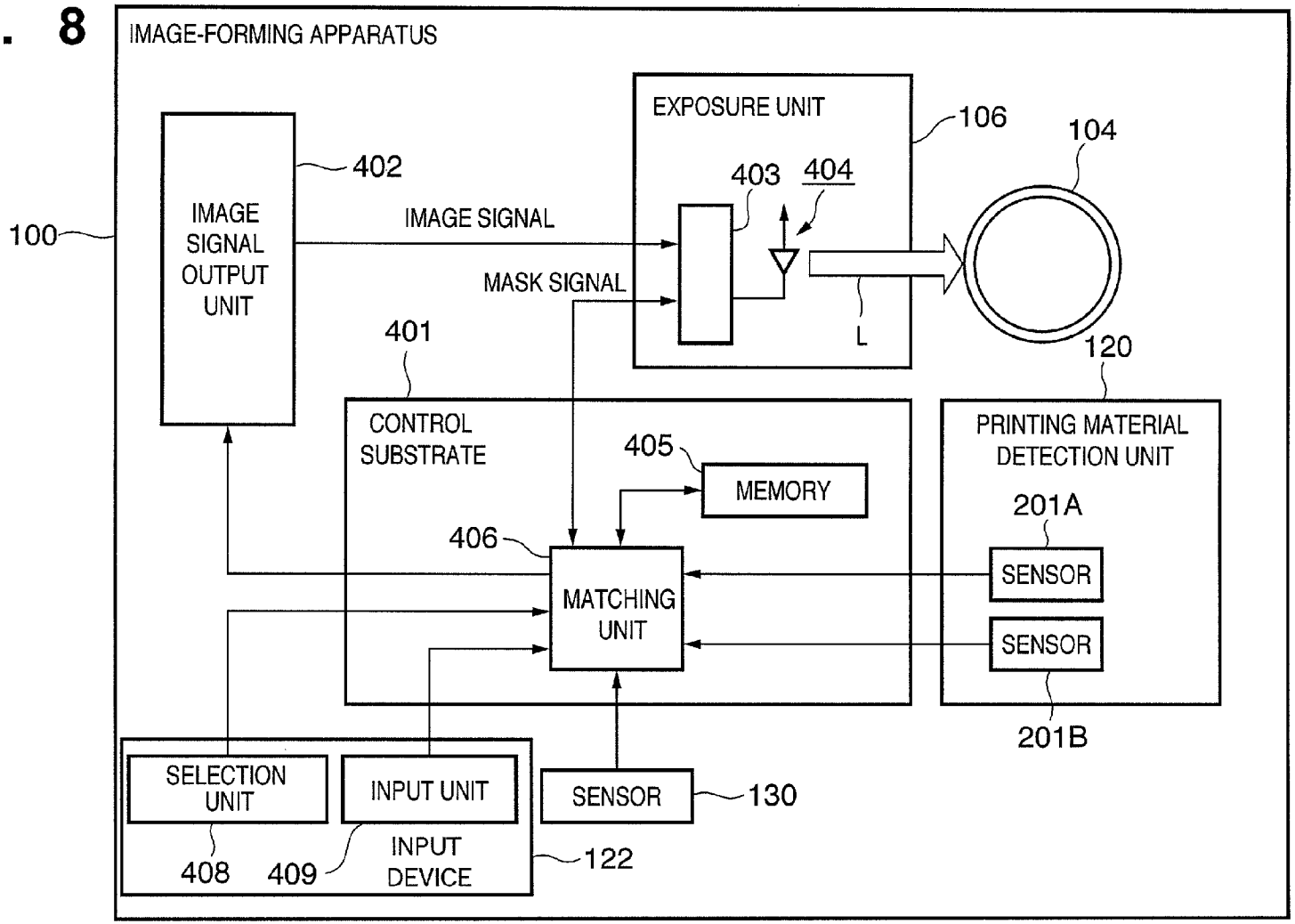
FIG. 8 is a block diagram illustrating control of an image forming apparatus in a second embodiment.

FIG. 8 is a block diagram illustrating control of the image forming apparatus in a second embodiment. Only elements relevant to the present invention are explained here. The image forming apparatus 100 of the present embodiment masks the image signals used to form toner images input to the exposure unit 106. As a result, in the present image forming apparatus, the size of the toner images is matched to the size of the printing material 101 and, at the same time, the formation position of the toner image is matched to the conveying position of the printing material 101. It should be noted that, in order to avoid repeating descriptions, only elements different from the image forming apparatus of the first embodiment are described here.

If printing without margins is selected via the selection unit 408, the matching unit 406 transmits the size designation of the printing material 101 input from the paper size sensor 130 to the image signal output unit 402. Based on the input size designation, an image signal forming a toner image larger than the size designation is output to the exposure unit 106 by the image signal output unit 402. In addition, a mask signal for masking the image signal is output by the matching unit 406 to the exposure unit 106 in conjunction with the image signal output from the image signal output unit 402.

The mask signal is generated from the orthogonal direction length x, conveying direction length y, orthogonal direction position X, and conveying direction position Y of the printing material 101. In the image signal output from the image signal output unit 402, pulses coinciding with the mask signal are partially extracted. In other words, the mask signal is a signal that removes some pulses corresponding to the toner image formed in excess of the detected size and conveying position of the printing material 101. Therefore, when the image signal is input, exposure unit 106 starts exposure of the photosensitive drum 104, but it adjusts the start and end of light emission in the laser diode 404 based on the mask signal. Consequently, the electrostatic latent image is formed on the photosensitive drum 104 such that it is matched to the size and conveying position of the printing material 101.

Figure 9:
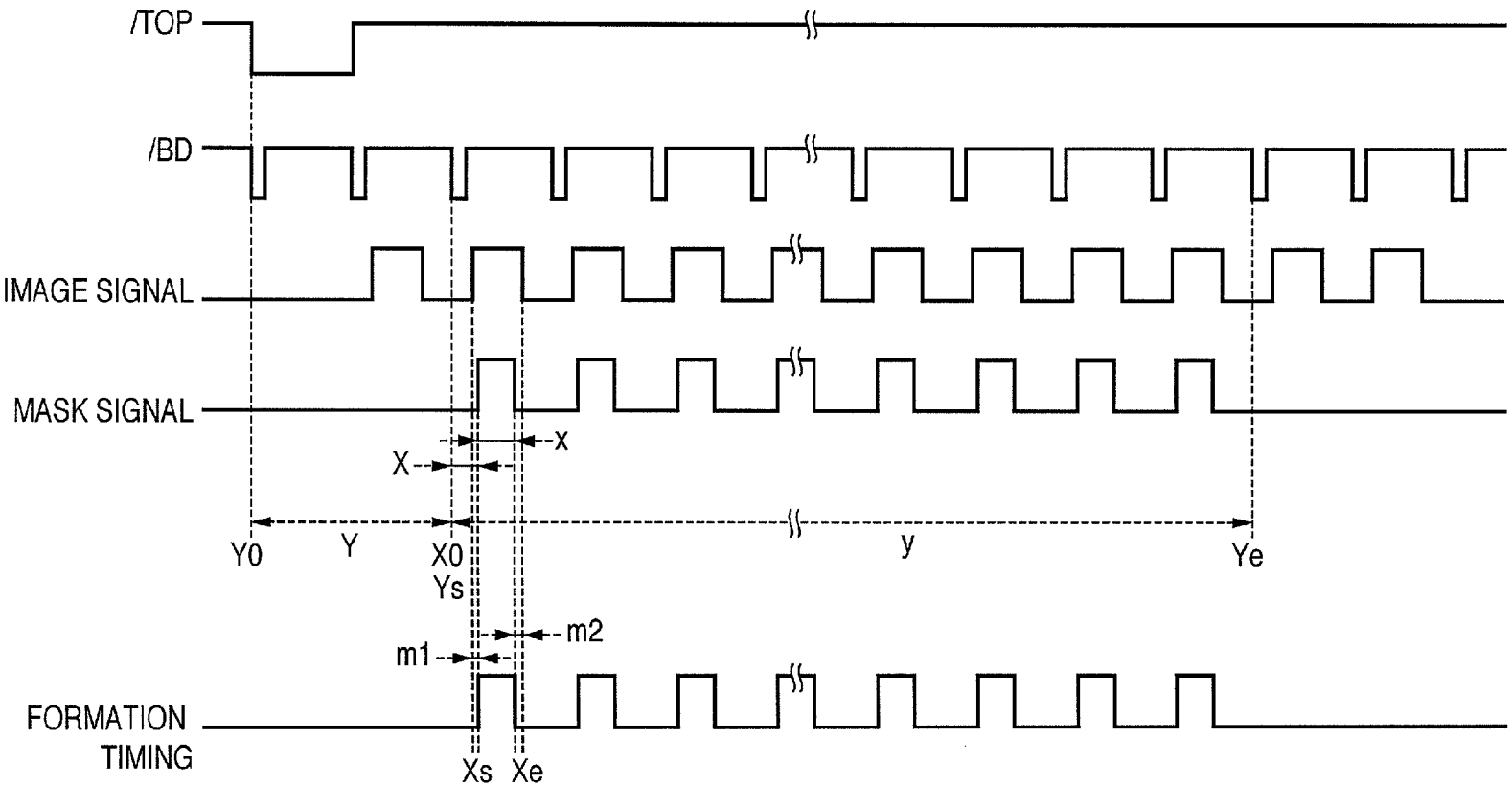
FIG. 9 is a timing chart of the image signal and mask signal obtained when printing without margins is selected in the second embodiment.

FIG. 9 is a timing chart of the image signal and mask signal obtained when printing without margins is selected in the second embodiment. /TOP shows a conveying direction reference signal and /BD shows a orthogonal direction reference signal. The image signal is made up of a plurality of pulses output from the image signal output unit 402 to the exposure unit 106 and having a pulse width corresponding to the length of the toner image in the orthogonal direction. The mask signal is output from the matching unit 406 to the exposure unit 106 and masks the image signal. The timing of formation shows the actual timing of light emission by the laser diode 404 in accordance with the image signal and mask signal.

The image signal output unit 402, in step with the reference signals /TOP and /BD, outputs an image signal forming a toner image larger than the size of the printing material 101 to the exposure unit 106. In addition, a mask signal for masking the image signal is output by the matching unit 406 to the exposure unit 106. First of all, upon elapse of the timing corresponding to the orthogonal direction position X and conveying direction position Y, the matching unit 406 outputs an initial mask signal having a width corresponding to the orthogonal direction length x.

After that, upon elapse of a timing corresponding to the orthogonal direction position X, for each orthogonal direction reference signal /BD, the matching unit 406 outputs a mask signal having a pulse width corresponding to the orthogonal direction length x. The mask signal is output starting from the moment when the initial mask signal is output and until elapse of the timing corresponding to the length y of the printing material 101 in the conveying direction. As shown in FIG. 9, when the mask signal is output, in the image signal, a portion of the pulses output with the same timing as the mask signal are extracted.

In this manner, the present image forming apparatus masks image signals output from the image signal output unit 402 based on the size and conveying position of the printing material 101 detected by the printing material detection unit 120. As a result, the formed toner image can be matched to the size and conveying position of the printing material 101.

Figure 10:
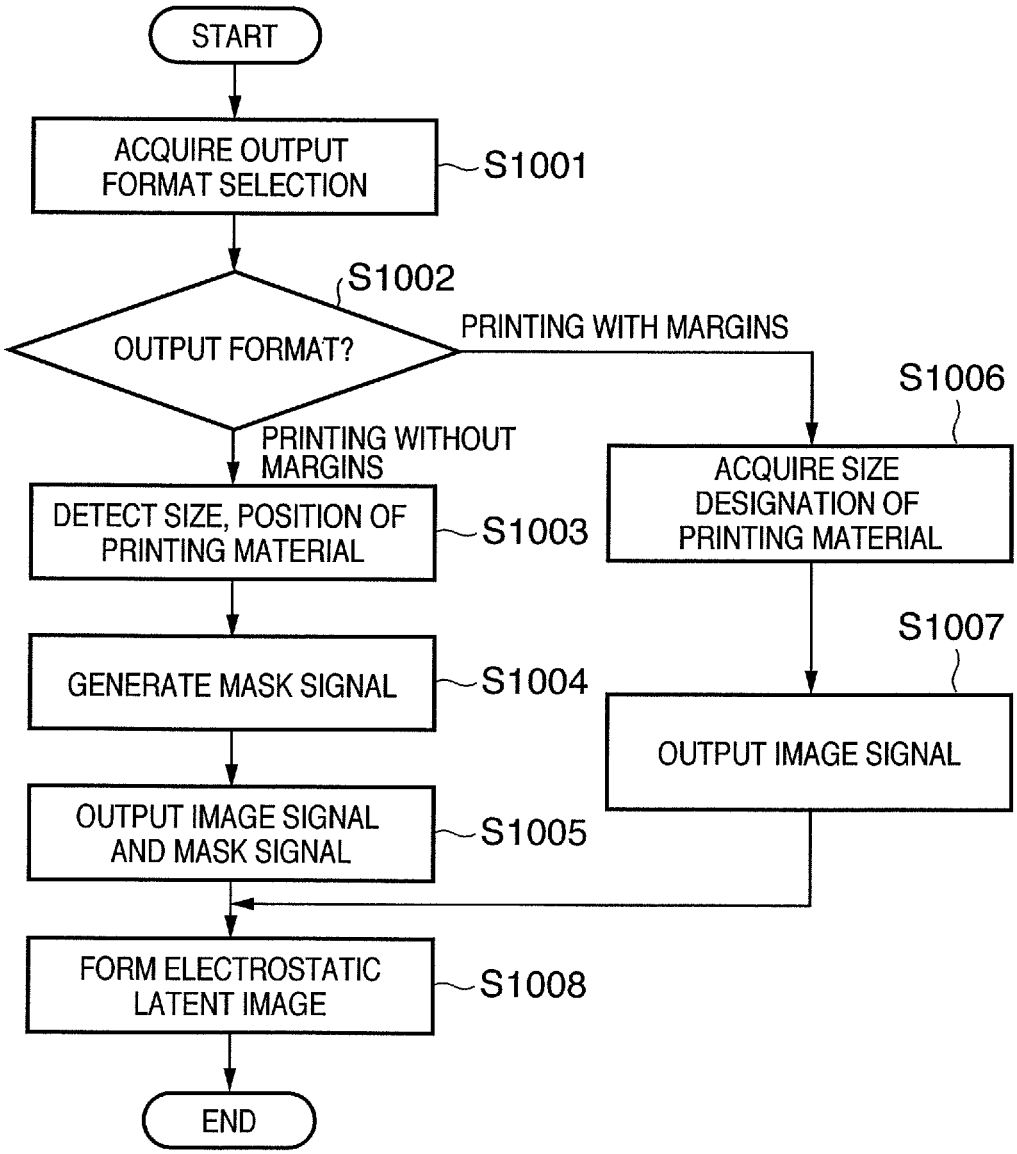
FIG. 10 is a flowchart illustrating control up to the moment of electrostatic latent image formation in the second embodiment.

FIG. 10 is a flowchart illustrating control up to the moment of electrostatic latent image formation in the second embodiment. According to the second embodiment, based on the size or conveying position of the printing material 101 detected by the printing material detection unit 120, the matching unit 406 generates a mask signal for masking the image signal in order to match the formed toner image to the size and conveying position of the printing material 101.

It should be noted that descriptions concerning technical features in common with the first embodiment are omitted in order to avoid repetition. For example, Steps S1001 and S1002 correspond to the above-described steps S701 and S702 and their descriptions are therefore omitted. In addition, if printing with margins is selected, the image forming apparatus used in the present embodiment performs operations similar to the first embodiment. Therefore, their descriptions are omitted. Accordingly, only descriptions related to steps S1004 and S1005 are provided below.

If printing without margins is selected by the user, in Step S1004, the matching unit 406 generates a mask signal that masks the image signal output from the image signal output unit 402. In addition, as explained with reference to FIG. 9, the mask signal is generated based on the size and conveying position of the printing material 101 detected by the printing material detection unit 120.

Next, in Step S1005, the image signal output unit 402 and matching unit 406, respectively, output an image signal and a mask signal. The image signal and mask signal can be output in a synchronized manner. The image signal output unit 402 outputs an image signal used to form a toner image larger than the size designation of the printing material 101.

The matching unit 406 may output the mask signal before the image signal is outputted. In such a case, exposure unit 106 has to maintain the mask signal until the image signal is output by the image signal output unit 402 and to synchronize the mask signal with the output of the image signal.

As described above, the image signal output unit according to the present embodiment outputs to the exposure unit an image signal used to form a toner image larger than the size of the printing material. Based on the detected length of the conveying printing material and on the conveying position of the printing material, the matching unit outputs a mask signal masking a portion of the pulses among the pulses contained in the image signal that are used to form an electrostatic latent image exceeding the size of the printing material. The exposure unit exposes the image carrier in accordance with the image signal masked in response to the mask signal. As a result, due to image signal masking, the present image forming apparatus does not need to spend excessive amounts of toner because at the moment of electrostatic latent image formation, the images are matched to the size and conveying position of the printing material. Thus, the present image forming apparatus can reduce the amount of spent toner and suppress the generation of waste toner.

Embodiment 3

Figure 11:
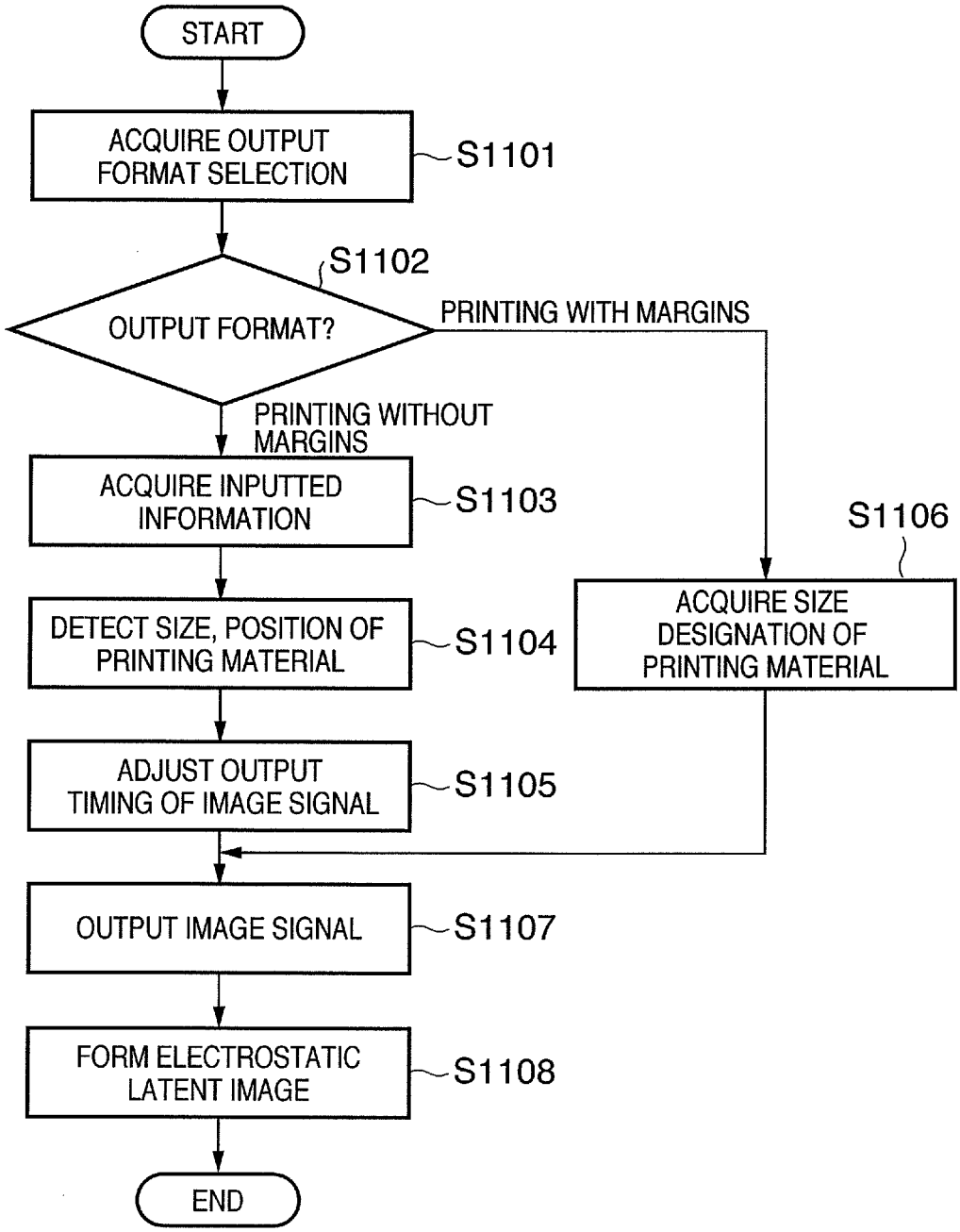
FIG. 11 is a flowchart illustrating control up to the moment of electrostatic latent image formation in a third embodiment.

FIG. 11 is a flowchart illustrating control up to the moment of electrostatic latent image formation in a third embodiment. According to the third embodiment, the matching unit 406 receives the size or conveying position of the printing material 101 detected by the printing material detection unit 120 and the adjustment values of the formation position of the toner image input from the input unit 409. Based on these two types of inputted information, the matching unit 406 matches the formed toner image to the size and conveying position of the printing material 101.

In addition, the present embodiment may be practiced in combination with the first embodiment or the second embodiment. Here, descriptions will be provided regarding an embodiment obtained as a combination with the first embodiment. It should be noted that descriptions concerning technical features in common with the first embodiment are omitted in order to avoid repetition. For example, Steps S1101 and S1102 correspond to the above-described S701 and S702 and their descriptions are therefore omitted. In addition, when printing with margins is selected, the image forming apparatus used in the present embodiment performs operations similar to the first embodiment. Therefore, their descriptions are omitted. Accordingly, only descriptions related to steps S1103 and S1105 are provided below.

If printing without margins is selected by the user, in Step S1103, the formation positions of the toner image in the orthogonal direction and conveying direction input by the user are acquired from the input unit 409 by the matching unit 406. In addition, in Step S1104, in the same manner as in the first embodiment, the matching unit 406 acquires the size and conveying position of the printing material 101 detected by the printing material detection unit 120.

Next, in Step S1105, the matching unit 406 matches the size and position of formation of the toner image to the size and conveying position of the printing material 101 based on the detected size and conveying position. Furthermore, the matching unit 406 fine-tunes the output start timing of the image signal using the input adjustment values. For instance, the matching unit 406 may adjust the conveying direction reference signal and orthogonal direction reference signal shown in FIG. 5 based on the input adjustment values.

To provide a more specific description, let us imagine that the image formed here is shifted, e.g., by 0.5 mm to the right from the conveying direction of the printing material 101. In such a case, the user inputs an adjustment value for the formation position in the orthogonal direction. The input method includes, for example, in inputting an instruction to form the image shifted 0.5 mm to the left. In response to the user's input, the matching unit 406 makes adjustments to the image signal output unit 402 so as to advance the output of the orthogonal direction reference signal /BD shown in FIG. 5. It should be noted that the advanced timing corresponds to 0.5 mm.

As described above, the image forming apparatus according to the present embodiment may further include an input unit for inputting at least one of the adjustment values for the formation position in the orthogonal direction and adjustment values for the formation position in the conveying direction. In such a case, based on the detected length and conveying position of the printing material and the input adjustment values, the matching unit may match the formation position of toner image to the printing material along with matching the image size of the toner image to the size of the printing material. As a result, when a problem arises in the present image forming apparatus during printing without margins, such as when the image formed on the printing material is shifted, etc., fine-tuning can be carried out based on the user's input. Based on that, the present image forming apparatus further improves precision during printing without margins. Thus, the present image forming apparatus can reduce the amount of spent toner and suppress waste toner generation.

The present invention can provide a printing without margins-enabled image forming apparatus, with the image forming apparatus forming toner images matched to the size and conveying position of the conveyed printing material and being capable of suppressing waste toner generation better than heretofore.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-048976 filed on Feb. 24, 2006, which is hereby incorporated by reference herein in its entirety.

What is claimed is:

1. An image forming apparatus, comprising:

a plurality of image carriers, on which an electrostatic latent image is formed;

a plurality of exposure units forming the electrostatic latent image on corresponding image carriers respectively;

a plurality of developers for developing the electrostatic latent image on corresponding image carriers respectively;

an intermediate transfer belt, on which a toner image is primarily transferred from the plurality of image carriers;

a plurality of primary transfer units transferring the toner image on corresponding image carriers to the intermediate transfer belt in a primary transfer position respectively;

a secondary transfer unit for transferring the toner image on the intermediate transfer belt to a printing material in a secondary transfer portion;

a registration roller that restricts a position of the printing material, and conveys the printing material to the secondary transfer portion at a predetermined timing;

a printing material detection unit being arranged at a position upstream from a position of the registration roller in a conveying direction of the printing material, and detecting a leading edge and a trailing edge of the printing material in order to determine a printing material length in the conveying direction, a printing material position in an orthogonal direction to the conveying direction, and a printing material length in the orthogonal direction; and a matching unit for controlling the plurality of exposure units;

wherein, the image forming apparatus is capable of forming two types of images including an image with margins and an image without margins, when the image is formed with margins, the printing material detection unit bypasses detection of the printing material length in the conveying direction, the printing material position in the orthogonal direction, and the printing material length in the orthogonal direction, and when the image is formed without margins, the registration roller stops the conveying of the printing material after the printing material detection unit detects the printing material length in the conveying direction, the printing material position in the orthogonal direction, and the printing material length in the orthogonal direction, then the plurality of exposure units respectively start an exposure for a corresponding image carrier in accordance with a control of the matching unit after detecting by the printing material detection unit, and then the plurality of exposure units respectively form the electrostatic latent image having a size matching the printing material length and the printing material position detected by the printing material detection unit, and wherein the image forming apparatus does not form toner images that are larger than the printing material, thereby reducing an amount of spent toner and suppressing generation of waste toner.

2. The image forming apparatus according to claim 1, further comprising:

an image signal output unit which outputs, to the plurality of exposure units, an image signal used to form the toner image, with the image signal comprising a plurality of pulses having a pulse width corresponding to the length of the toner image in the orthogonal direction.

3. The image forming apparatus according to claim 2, wherein the matching unit adjusts output start timing of each pulse in the image signal based on a detected printing material position and adjusts output completion timing of each pulse in the image signal based on a detected printing material length, and the image signal output unit outputs the image signal to the plurality of exposure units in accordance with the adjusted output start timing and output completion timing.

4. The image forming apparatus according to claim 2, wherein the image signal output unit outputs the image signal used to form toner image of a size larger than the size of the printing material to the plurality of exposure units, the matching unit, based on the detected printing material length and the printing material position, outputs a mask signal masking pulses among the pulses contained in the image signal that form electrostatic latent image exceeding the size of the printing material, and the plurality of exposure units expose the plurality of image carriers in accordance with the image signal masked by the mask signal.

5. The image forming apparatus according to claim 1, further comprising an input unit for inputting at least one of adjustment values for the formation position in the orthogonal direction and adjustment values for the formation position in the conveying direction, and the matching unit, based on a detected printing material length and the printing material position and the input adjustment values, matches the size of the toner image to the size of the printing material and matches the formation position of the toner image to the printing material position.

6. An image forming apparatus, comprising:

a plurality of image carriers, on which an electrostatic latent image is formed;

a plurality of exposure units forming the electrostatic latent image on corresponding image carriers respectively;

a plurality of developers for developing the electrostatic latent image on corresponding image carriers respectively;

an intermediate transfer belt, on which a toner image is primarily transferred from the plurality of image carriers;

a plurality of primary transfer units transferring the toner image on corresponding image carriers to the intermediate transfer belt in a primary transfer position respectively;

a secondary transfer unit for transferring the toner image on the intermediate transfer belt to a printing material in a secondary transfer portion;

a registration roller that restricts a position of the printing material, and conveys the printing material to the secondary transfer portion at a predetermined timing;

a printing material detection unit being arranged at a position upstream from a position of the registration roller in a conveying direction of the printing material, and detecting a leading edge and a trailing edge of the printing material in order to determine a printing material length in the conveying direction, a printing material position in an orthogonal direction to the conveying direction, and a printing material length in the orthogonal direction; and a matching unit for controlling the plurality of exposure units;

wherein, the image forming apparatus is capable of forming two types of images including an image with margins and an image without margins, when the image is formed with margins, the printing material detection unit bypasses detection of the printing material length in the conveying direction, the printing material position in the orthogonal direction, and the printing material length in the orthogonal direction, and when the image is formed without margins, the registration roller stops the conveying of the printing material after the printing material detection unit detects the printing material length in the conveying direction, the printing material position in the orthogonal direction, and the printing material length in the orthogonal direction, and all exposure units respectively form the electrostatic latent image having a size corresponding to the printing material length in the conveying direction and the printing material position in the orthogonal direction to the conveying direction detected by the printing material detection unit after the printing material detection unit detects the printing material length in the conveying direction, the printing material position in the orthogonal direction, and the printing material length in the orthogonal direction, and wherein the image forming apparatus does not form toner images that are larger than the printing material, thereby reducing an amount of spent toner and suppressing generation of waste toner.

7. The image forming apparatus according to claim 6, further comprising:

an image signal output unit which outputs, to the plurality of exposure units, an image signal used to form the toner image, with the image signal comprising a plurality of pulses having a pulse width corresponding to the length of the toner image in the orthogonal direction.

8. The image forming apparatus according to claim 7, wherein the matching unit adjusts output start timing of each pulse in the image signal based on a detected printing material position and adjusts output completion timing of each pulse in the image signal based on a detected printing material length, and the image signal output unit outputs the image signal to the plurality of exposure units in accordance with the adjusted output start timing and output completion timing.

9. The image forming apparatus according to claim 6, wherein the image signal output unit outputs the image signal used to form toner image of a size larger than the size of the printing material to the plurality of exposure units, the matching unit, based on the detected printing material length and the printing material position, outputs a mask signal masking pulses among the pulses contained in the image signal that form electrostatic latent image exceeding the size of the printing material, and the plurality of exposure units expose the plurality of image carriers in accordance with the image signal masked by the mask signal.

10. The image forming apparatus according to claim 6, further comprising an input unit for inputting at least one of adjustment values for the formation position in the orthogonal direction and adjustment values for the formation position in the conveying direction, and the matching unit, based on a detected printing material length and the printing material position and the input adjustment values, matches the size of the toner image to the size of the printing material and matches the formation position of the toner image to the printing material position.

11. An image forming apparatus, comprising:

a plurality of image carriers, on which an electrostatic latent image is formed;

a plurality of exposure units forming the electrostatic latent image on corresponding image carriers respectively;

a plurality of developers for developing the electrostatic latent image on corresponding image carriers respectively;

an intermediate transfer belt, on which a toner image is primarily transferred from the plurality of image carriers;

a transfer member for providing a transfer portion with the intermediate transfer belt, and secondarily transferring the toner image from the intermediate transfer belt to a printing material conveyed on the transfer portion;

a registration roller for conveying the printing material to the transfer portion at a predetermined timing; and a printing material detection unit being arranged at a position upstream from a position of the registration roller in a conveying direction of the printing material, and detecting a leading edge and a trailing edge of the printing material in order to determine a printing material length in the conveying direction, a printing material position in an orthogonal direction to the conveying direction, and a printing material length in the orthogonal direction;

wherein the image forming apparatus is capable of forming an image without margins, when the image is formed without margins, all exposure units respectively form the electrostatic latent image having a size corresponding to the printing material length in the conveying direction, the printing material position in the orthogonal direction to the conveying direction, and the printing material length in the orthogonal direction to the conveying direction detected by the printing material detection unit after the printing material detection unit detects the printing material length in the conveying direction, the printing material position in the orthogonal direction, and the printing material length in the orthogonal direction, and wherein the image forming apparatus does not form toner images that are larger than the printing material, thereby reducing an amount of spent toner and suppressing generation of waste toner.

12. The image forming apparatus according to claim 11, wherein the registration roller stops or reduces the conveying of the printing material so that the printing material is conveyed to the transfer portion at the predetermined timing after the printing material detection unit detects a length in a conveying direction of the printing material being conveyed to the registration roller, a length in an width direction orthogonal to the conveying direction, and a conveying position in the width direction.

* * * * *